United States Patent [19]

Knox

[11] Patent Number: 4,493,592

[45] Date of Patent: Jan. 15, 1985

[54] GROUTING METHOD

[75] Inventor: Lloyd C. Knox, Duncan, Okla.

[73] Assignee: Halliburton Company, Duncan, Okla.

[21] Appl. No.: 425,346

[22] Filed: Sep. 28, 1982

[51] Int. Cl.[3] ..... E02B 17/00

[52] U.S. Cl. ..... 405/225; 405/227

[58] Field of Search ..... 405/222, 223, 225, 227, 405/233, 263, 266, 267; 166/292; 264/31, 32, 34

[56] References Cited

U.S. PATENT DOCUMENTS

| | | |
|---|---|---|
| Re. 28,232 | 11/1974 | Bassett et al. . |
| 3,468,132 | 3/1967 | Harris . |
| 3,878,687 | 4/1975 | Tragesser, Jr. . |
| 4,009,581 | 3/1977 | Britton et al. . |
| 4,014,174 | 3/1977 | Mondshine . |
| 4,047,391 | 9/1977 | Mayfield et al. . |
| 4,052,861 | 10/1977 | Malone et al. . |
| 4,063,421 | 12/1977 | Coone et al. . |
| 4,063,427 | 12/1977 | Hoffman . |
| 4,077,224 | 3/1978 | Coone . |
| 4,140,426 | 2/1979 | Knox . |
| 4,171,923 | 10/1979 | Landers . |
| 4,184,790 | 1/1980 | Bassett . |
| 4,275,974 | 6/1981 | Knox et al. . |
| 4,422,805 | 12/1983 | Sweatman ..... 405/225 |
| 4,428,424 | 1/1984 | Lacy et al. ..... 166/292 X |

*Primary Examiner*—David H. Corbin

*Attorney, Agent, or Firm*—Thomas R. Weaver; James R. Duzan

[57] ABSTRACT

A method of grouting using aqueous solutions of alkali silicate materials in sealing the annular space formed between either a jacket leg or pile sleeve and a pile driven therethrough of an offshore platform, or other similar annular space, to support a column of grout thereon.

16 Claims, 2 Drawing Figures

GROUTING METHOD

BACKGROUND OF THE INVENTION

This invention relates to an improved grouting method for grouting the annulus between either a jacket leg or pile sleeve and a pile driven therethrough or any similar annular shape of an offshore platform used in well drilling and production.

The prior art teaches several different methods of grouting the annular space formed between either a jacket leg or pile sleeve and a pile driven therethrough of offshore platforms. Typically, the methods involve setting a grout plug or column of grout which is supported either by the bottom of the body of water upon which the platform is installed or on a grout seal and subsequently filling the annular space above the plug with grouting material. Such typical prior art grouting methods are illustrated in U.S. Pat. Nos. Re. 28,232, 3,468,132, 3,878,687, 4,009,581, 4,047,391, 4,052,861, 4,063,421, 4,063,427, 4,077,224, 4,140,426, 4,171,923 and 4,275,974.

However, should such a grout plug or column not be supported by either a grout seal or bottom of the body of water, the grout will merely run out the bottom of the annular space into the surrounding water or area. Also, if some way of sealing the annulus cannot be found so that a grout plug or column can be placed in the annulus and allowed to harden, the annulus cannot be filled with grouting thereby affecting the stability of the offshore platform.

Previously, when trying to seal the annular space a wide variety of materials have been used. Typically, fast setting gypsum cements have been tried, lost circulation materials used in well drilling have been tried, etc. In some instances where the annular space is accessible, divers have sealed or tried to seal the annular space by filling it from the bottom with sacks, rags, rubber materials, etc.

However, the use of fast setting gypsum cements plug up flow lines, lost circulation materials used in well drilling operations have not proven satisfactory since they are usually not capable of bridging large open areas, and the use of divers is expensive.

To consolidate the surface of a borehole in an incompetent formation and strengthen the bond between the surface of the borehole and cement placed therein the prior art teaches the method of forcing a multivalent cation salt into the formation, thereafter forcing an alkali metal silicate solution which has a pH less than 12.0 containing at least 12% by weight silica into the formation, and thereafter forcing an aqueous cement slurry containing at least 2% by weight of a water soluable multivalent cation salt to contact the surface of the borehole. Such a prior art method is disclosed in U.S. Pat. No. 4,1014,174.

STATEMENT OF THE INVENTION

The present invention is directed to an improved grouting method using aqueous solutions of alkali silicate materials in sealing the annular space formed between either a jacket leg or pile sleeve and a pile driven therethrough or similar annular space of an offshore platform to support a column of grout thereon so that the annular space may ultimately be filled with grouting material.

BRIEF DESCRIPTION OF THE DRAWINGS

The present invention will be better understood when taken in conjunction with the following drawings wherein:

FIG. 1 shows a typical offshore platform having jacket legs and pile sleeves thereon having piling driven there through.

DESCRIPTION OF THE INVENTION

Figure 1:
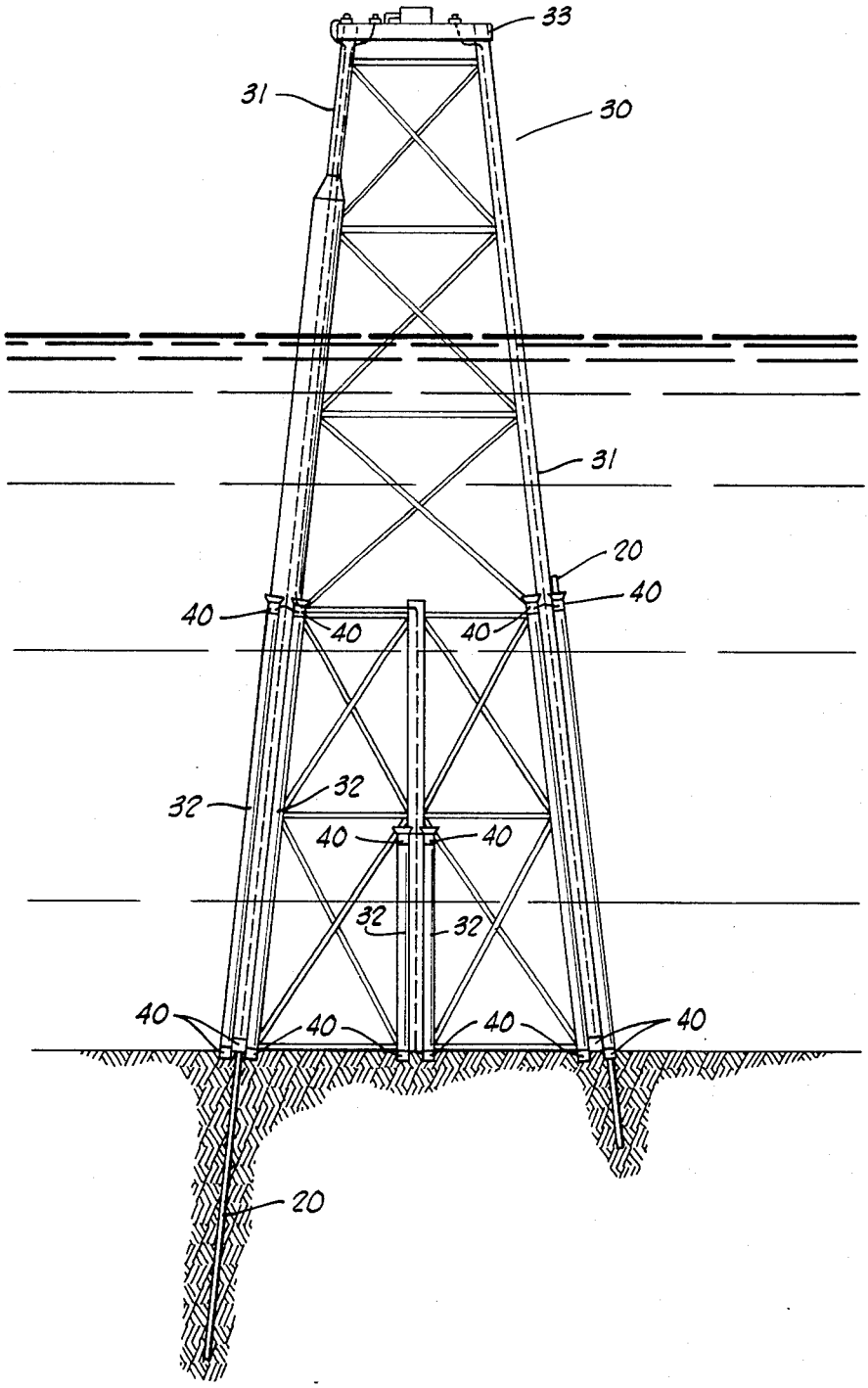

Referring to FIG. 1, an offshore platform 30 is shown having inflatable packers 40 installed in the bottom of jacket leg 31 and in the top and bottom of pile sleeves 32. Piles 20 are shown as being driven to depth through one of the jacket legs 31 and pile sleeve 32.

Figure 2:
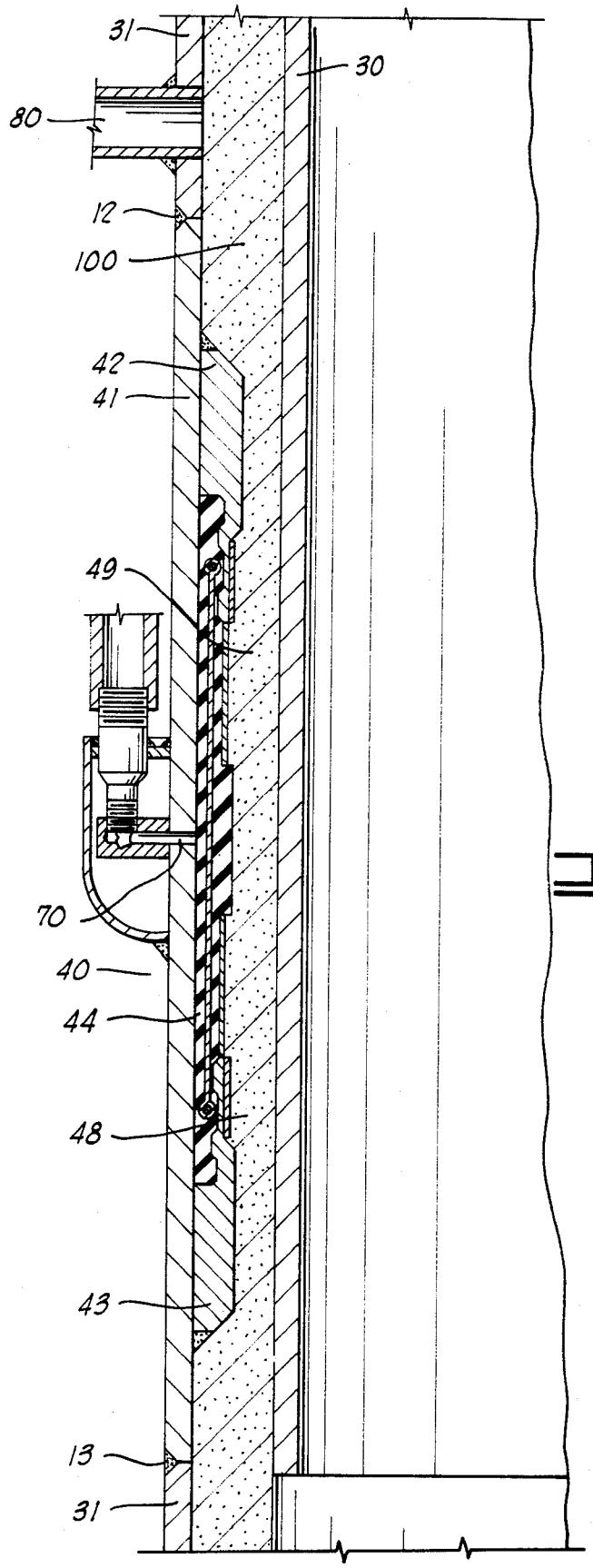
FIG. 2 shows the present invention in cross-section in leg or pile sleeve and a pile driven therethrough of an offshore platform.

Referring to FIG. 2, an inflatable packer 40 is shown in a jacket leg 31 having a pile 20 driven therethrough. The inflatable packer 40 comprises a packer housing 41, guide rings 42 and 43, an elastomeric packer member 44 and packer member back-up shoes 48 and 49. The packer housing 41 is cylindrical and made in any convenient diameter to match the jacket leg 31 to which it is welded as at 12 and 13. The inflation port 70 for the packer 40 is shown extending through the packer housing 41. A grout line 80 is shown extending through the jacket leg 31 to allow grouting material to flow into the annulus formed between the jacket leg 31 having a pile 20 driven therethrough.

If during platform grouting operations the inflatable packer 40 fails to inflate to seal the annulus between the jacket leg 31 and pile 20, a way must be found to seal the annulus to support an initial plug of grouting material, if the bottom of the body of water in which the offshore platform is installed is too soft to support the weight of an initial grout plug or if the jacket leg 31 is not resting in or on the bottom of the body of water. Since the bottom of the jacket leg 31 is located below the surface of the water, in many instances hundreds of feet, it is highly desirable to have a material that can be pumped into the annulus between the jacket leg 31 and pile 20 to seal the annulus, have great enough load bearing strength to support an initial plug of grout thereon even if the jacket leg 31 is above the bottom of the body of water and will not plug the grout line 80 after pumping the material therethrough leaving the grout line 80 suitable for further use.

Such a material 100 is shown filling the annulus between the jacket leg 31 and pile 20.

The improved grouting method of the present invention makes use of such a material and comprises first pumping or injecting a fresh water spacer down the grout line 80 into the annulus between the jacket leg 31 and pile 20, secondly pumping or injecting an alkali silicate material which flocculates upon contact with sea water down the grout line 80 into the annulus between the jacket leg 31 and pile 20 to seal the annulus, thirdly pumping or injecting a fresh water spacer down the grout line 80 into the annulus between the jacket leg 31 and pile 20 and subsequently pumping or injecting any suitable cement or grouting material down the grout line 80 into the annulus between the jacket leg 31 and pile 20. If desired, a spacer fluid containing di-or polyvalent cations, such as a potassium chloride solution, calcium chloride solution, etc. may be pumped into the annulus before the initial fresh water spacer to provide higher concentration of di-or polyvalent cations in the annulus.

The improved grouting method can be used to seal the annulus between either a jacket leg or pile sleeve and a pile driven therethrough; or, any other annulus of an offshore platform where it is desired to support the pressure of a column of cement or grout. If in trying to seal the annulus between a pile sleeve and pile driven therethrough of an offshore platform the grout lines have been previously plugged with cement or grouting material, the method of the current invention can be carried out by inserting a line into the annulus and running it to the lowest position therein. Similarly, divers may be employed to attach valves to the jacket leg or pile sleeve to which lines may be attached to carry out the method of the current invention.

The preferred alkali silicate material which flocculates upon contact with sea water to be used in the improved method of grouting of the current invention is a aqueous sodium silicate solution sold under the trademark Flo-Chek Chemical A additive by Halliburton Services, a division of Halliburton Company.

An alternate material which can be used in the improved method of grouting of the present invention when mixed into an aqueous solution is a powdered silicate having a high ratio of silicon dioxide to alkali metal oxide sold under the trademark Flo-Chek P additive by Halliburton Services, a division of Halliburton Company.

When using the preferred material, Flo-Chek Chemical A additive, in the improved method of grouting of the present invention, any desired amount of material may be pumped or injected into the annulus to be grouted depending upon the strength required to support the desired column of cement or grout to be injected into the leg to form a plug or fill the annulus. If enough Flo-Chek Chemical A additive is pumped or injected into the annulus to be grouted to fill approximately four (4) feet of axial length of the annular space, this should be sufficient to support a column of cement or grout to be injected into the annulus to be grouted depending upon the strength required to support such a column.

Since either the Flo-Chek Chemical A additive or Flo-Chek P additive flocculates upon contact with sea water having di- or polyvalent cations therein, it is not necessary for the annulus to be otherwise sealed to support the pressure from the subsequent injection of cement or grout.

Although Flo-Chek Chemical A additive or Flo-Chek P additive are the preferred materials to be used in the improved grouting method of the present invention, any alkali silicate having a molar ratio of silicon dioxide ($SiO_2$) to alkali metal oxide (sodium, potassium, ammonium or lithium) between approximately 1.6 or less to 4.0 may be used.

Also, although it is preferred to use an initial spacer of fresh water before the injection of the alkali silicate material and spacer of fresh water after the injection of the alkali silicate material, the fresh water spacers may be eliminated, if the alkali silicate material can be prevented from flocculating during pumping through the grout line before entering the annulus.

Having thus described our invention, we claim:

1. A method of grouting the annular space formed between either a jacket leg or pile sleeve and a pile driven therethrough of an offshore platform, or other similar annular space, said method comprising the steps of:

injecting an alkali silicate material which flocculates upon contact with sea water into said annular space;

confining substantially within said annular space the alkali silicate material which has flocculated upon contact with the sea water thereby forming an annular plug of flocculated alkali silicate material substantially within said annular space;

injecting cement or grout into said annular space; and supporting the cement or grout injected into said annular space by the alkali silicate material which has flocculated until the cement or grout has set.

2. The method of grouting claim 1 wherein said alkali silicate material comprises an aqueous sodium silicate solution.

3. The method of grouting of claim 1 wherein said alkali silicate material comprises an aqueous potassium silicate solution.

4. The method of grouting of claim 1 wherein said alkali silicate material comprises an aqueous ammonium silicate solution.

5. The method of grouting of claim 1 wherein said alkali silicate material comprises an aqueous lithium silicate solution.

6. The method of grouting of claim 1 further comprising the steps of:

injecting a spacer of fresh water into said space before the step of injecting an alkali silicate material; and injecting a spacer of fresh water into said space after the step of injecting an alkali silicate material.

7. The method of grouting of claim 1 further comprising the step of:

injecting a spacer of di- or polyvalent cation fluid into said space before the step of injecting an alkali silicate material.

8. The method of grouting of claim 1 wherein said alkali silicate material is an aqueous solution of Flo-Chek additive.

9. A method of grouting the annular space formed between either a jacket leg or pile sleeve and a pile driven therethrough of an offshore platform, or other similar annular space, said method comprising the steps of:

injecting a spacer of fresh water into said annular space;

injecting an alkali silicate material which flocculates upon contact with sea water into said annular space;

confining substantially within said annular space the alkali silicate material which has flocculated upon contact with a di- or polyvalent cation fluid in said annular space thereby forming an annular plug of flocculated alkali silicate material substantially within said annular space;

injecting a spacer of fresh water into said annular space;

injecting cement or grout into said annular space; and supporting the cement or grout injected into said annular space by the alkali silicate material which has flocculated until the cement or grout has set.

10. The method of grouting of claim 8 wherein said alkali silicate material comprises an aqueous lithium silicate solution.

11. The grouting method of claim 9 further comprising the step of:

injecting a spacer of a di- or polyvalent cation fluid into said space before the step of injecting an alkali silicate material.

12. The method of grouting of claim 9 wherein said alkali silicate material comprises an aqueous sodium silicate solution.

13. The method of grouting of claim 9 wherein said alkali silicate material comprises an aqueous potassium silicate solution.

14. The method of grouting of claim 9 wherein said alkali silicate material comprises an aqueous ammonium silicate solution.

15. The method of grouting of claim 9 wherein said alkali silicate material comprises an aqueous solution of Flo-Chek additive.

16. A method of grouting the annular space formed between either a jacket leg or pile sleeve and a pile driven therethrough of an offshore platform, or other similar annular space, said method comprising the steps of:

injecting a spacer of a di- or polyvalent fluid into said annular space;

injecting a spacer of fresh water into said annular space;

injecting an alkali silicate material comprising an aqueous solution of Flo-Chek additive which flocculates upon contact with either sea water or the di- or polyvalent fluid into said annular space;

confining substantially within said annular space the alkali silicate material which has flocculated upon contact with either the sea water or di- or polyvalent fluid thereby forming an annular plug of flocculated alkali silicate material substantially within said annular space;

injecting a spacer of fresh water into said annular space;

injecting cement or grout into said annular space; and supporting the cement or grout injected into said annular space by the alkali silicate material which has flocculated until the cement or grout has set.

* * * * *

UNITED STATES PATENT AND TRADEMARK OFFICE

CERTIFICATE OF CORRECTION

PATENT NO. : 4,493,592

DATED : January 15, 1985

INVENTOR(S) : Lloyd C. Knox, et al

It is certified that error appears in the above-identified patent and that said Letters Patent is hereby corrected as shown below:

On the title page, Item [75] Inventors:

Add as a co-inventor --William Gursky, Jr., Duncan, Okla.--.

Column 1, line 58, delete "4,1014,174" and insert therefor --4,014,174--.

Column 2, line 8, delete the words "there through" and insert therefor --therethrough--.

Signed and Sealed this

*Fourteenth* Day of *May 1985*

[SEAL]

*Attest:*

DONALD J. QUIGG

*Attesting Officer* *Acting Commissioner of Patents and Trademarks*